United States Patent [19]

Skene

[11] Patent Number: 4,592,125

[45] Date of Patent: Jun. 3, 1986

[54] METHOD AND APPARATUS FOR ANALYSIS OF TORQUE APPLIED TO A JOINT

[75] Inventor: William Skene, Aberdeen, Scotland

[73] Assignee: Salvesen Drilling Limited, Aberdeen, Scotland

[21] Appl. No.: 657,440

[22] Filed: Oct. 2, 1984

[30] Foreign Application Priority Data

Oct. 6, 1983 [GB] United Kingdom ..... 8326736

[51] Int. Cl.[4] ..... B23Q 17/00

[52] U.S. Cl. ..... 29/407

[58] Field of Search ..... 29/407; 73/862.19, 862.33, 73/862.08, 862.23

[56] References Cited

U.S. PATENT DOCUMENTS 4,402,052 8/1983 Stone et al. ..... 29/407

*Primary Examiner*—Howard N. Goldberg
*Assistant Examiner*—Steven Nichols
*Attorney, Agent, or Firm*—Leydig, Voit & Mayer, Ltd.

[57] ABSTRACT

The invention relates to a method and apparatus for continuously monitoring the making-up a joint between two mutually-engageable threaded members (12,13,14,22,23), the threaded members having co-operating shoulder seal elements (18,19,20,21). The invention involves the application of torque to the mutually-engaging members and detecting when a shoulder-engaging position has been reached. A predetermined additional torque is then applied if a good joint is indicated as being achievable. If a good joint is indicated as not being achievable, the application of additional torque is terminated.

16 Claims, 9 Drawing Figures

METHOD AND APPARATUS FOR ANALYSIS OF TORQUE APPLIED TO A JOINT

This invention relates to a method and apparatus for analysing the torque applied to a joint and is particularly concerned with a system for continuously monitoring in real time the torque applied to a joint and the relative rotational movement of male and female connectors making up the joint.

When joining lengths of tubing or casing, such as production tubing for oil wells, the nature of the joint between the lengths of tubing is critical. It is now conventional to form such lengths of tubing or casing to standards laid down by the American Petroleum Institute (API). Each length of tubing is formed at one end with an internal threading and at the other end with an external threading, the externally-threaded end of one length of tubing being adapted to engage in the internally-threaded end of another length of tubing. Connections (hereinafter referred to as the API type) between lengths of such casing or tubing rely on thread interference and the interposition of a thread compound to provide a seal and no shoulder is provided on the internally-threaded end for engagement with the externally-threaded end of a connected tubing length.

Tables are published incorporating standards including values for torque and number of turns which are required in various circumstances to enable two such lengths of tubing to be connected together in order to achieve a satisfactory secure and leakproof joint.

Various methods and apparatus have previously been proposed for making up threaded pipe joints of the aforesaid API type. One previously proposed method involves the connection of two co-operating threaded pipe sections, measuring the torque applied to rotate one section relative to the other and the number of rotations or turns which one section makes relative to the other. Signals indicative of the torque and turns are fed to a controller which ascertains whether the measured torque and turns fall within a predetermined range of torque and turns which are known to produce a good joint. An output signal, e.g. an audible signal, is then operated to indicate whether the joint is a good or a bad joint.

It will be noted that, in general, the aforesaid previously proposed arrangement records only the final makeup characteristics of torque and turns and thereby determines whether the pipe connection concerned is good or bad. The comparison as to whether the connection falls within the desired parameters of torque and turns is not effected continuously throughout the make up of the joint nor is it effected in real time.

The above previously proposed arrangement is substantially effective for connections of the API type. It has been found, however, that for some oil well tubing and casing such connections are not sufficiently secure or leakproof and it is now conventional to provide so-called "premium grade" tubing or casing which is manufactured to at least API standards but in which a metal-to-metal sealing area is provided between the lengths. In this case the internal threading of one length of tubing or casing terminates in a shoulder and the externally-threaded end of another length is adapted to engage in the internally threaded end up to engagement with the shoulder—the so-called "shoulder" position—to cause engagement of the metal-to-metal seal. For convenience, such threading on premium grade tubing or casing will be hereinafter referred to as "premium threading" and it will be understood that in this specification and claims the term "premium grade tubing" means tubing wherein one length can be connected to another by means of a joint incorporating a shoulder which assists in sealing of the joint. Torque and turn values indicating a final make-up condition cannot be applied to the make-up of a joint using premium grade tubing as a leakproof seal may not necessarily be achieved thereby even although appropriate final torque and turn values are indicated.

The manufacturers of premium grade connections publish torque values required for correct make-up of joints utilising a particular tubing. Such published values may be based on minimum, optimum and maximum torque values, an optimum and maximum torque values, or an optimum torque value only.

Turns values are generally based on a finite rotational measurement from a predetermined reference position. Such turns values are determined from the final make-up characteristics of particular connections acquired through operational knowledge.

In joining two lengths of tubing or casing, one length is held in a vertical position with its internally-threaded end uppermost and a second length is suspended above the first with its externally-threaded end lowermost. The second length is then screwed into the first using a so-called tong unit. which has substantially the shape of an elliptical disc, bearing in the region of one of its axes a rotary table adapted to grip the upper length and screw the end of it into the lower length while the latter is held stationary. The rotary table is driven hydraulically and the driving means and ancillary equipment therefor are mounted on the disc, with hydraulic power supplied from a remote source. Such tong units are well known.

As indicated above, a leakproof metal-to-metal seal is to be achieved, and in order for the seal to be effective, the amount of torque applied to effectively energise the metal-to-metal seal and to the shoulder is critical.

It is an object of the invention to provide a method and apparatus for continuously monitoring the torque applied during the joining of the lengths of tubing or casing of the premium grade type to enable a satisfactorily leakproof seal to be achieved.

According to the present invention there is provided a method of making up a joint between two mutually-engageable threaded members which have a shoulder seal incorporated therein, said method comprising continuously monitoring the torque applied to rotate a first of said members relative to the second member; continuously monitoring the engaging relationship of the first and second members between a first position and a second position; detecting torque applied adjacent the location at which shoulder engagement takes place; comparing said shoulder torque in relation to a predetermined optimum torque and predetermined maximum torque; and either applying further torque amounting to a proportion of said optimum torque if the addition of said proportion of the optimum torque to the shoulder torque does not exceed the maximum torque and thereby effecting a good joint or ceasing to apply further torque if the torque comparison indicates that a good joint cannot be achieved.

According to a further aspect of the present invention there is provided apparatus for making up a joint between two mutually engageable threaded tubular members which have a shoulder seal incorporated therein, said apparatus comprising monitoring means for continuously measuring the torque applied to rotate a first of said members relative to the second member, monitoring means for continuously measuring the engaging relationship of the first and second members between a first position and a second position characterised in that there is provided means for detecting torque applied at the location adjacent which shoulder engagement takes place; comparison means for comparing said shoulder torque in relation to a predetermined optimum torque and predetermined maximum torque; and control means for either applying further torque amounting to a proportion of said optimum torque if the addition of said proportion of the optimum torque to the shoulder torque does not exceed the maximum torque and thereby effecting a good joint or ceasing to apply further torque if the torque comparison indicates that a good joint cannot be achieved.

The members to be joined are preferably lengths of production tubing or casing for oil wells formed with the aforesaid premium threads and the torque-applying means is preferably a conventional tong unit. The system may include a horn operable by the comparison means to provide an audible signal to personnel making up the joint, and a proximity detector.

Preferably, display means is arranged to present the data in the form of a colour graph and to provide a colour change when the so-called "shoulder" position is reached when joining tubing provided with premium threads.

An embodiment of the present invention will now be described, by way of example, with reference to the accompanying drawings in which.

Figure 1:
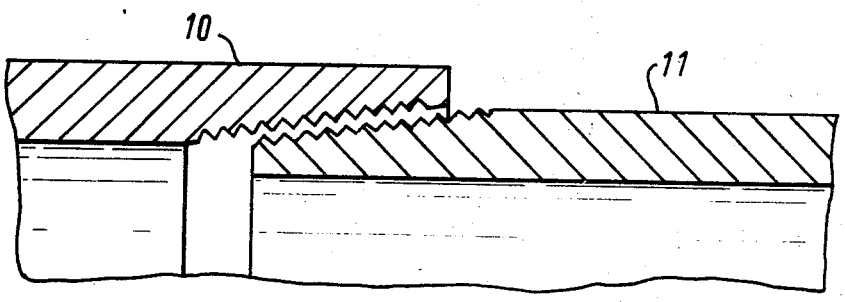
FIG. 1 is a diagrammatic fragmentary sectional view illustrating a tubing joint of the API type (as hereinbefore defined)

Referring to the drawings, FIG. 1 shows a diagrammatic representation of a tubing joint of the API type a joint wherein a first tubing length 10 has an internally screw-threaded bore into which is engageable an externally threaded end of a second tubing length 11. It will be noted that sealing between the tubing lengths 10 and 11 is achieved solely by means of the threaded connection therebetween.

Figure 2:
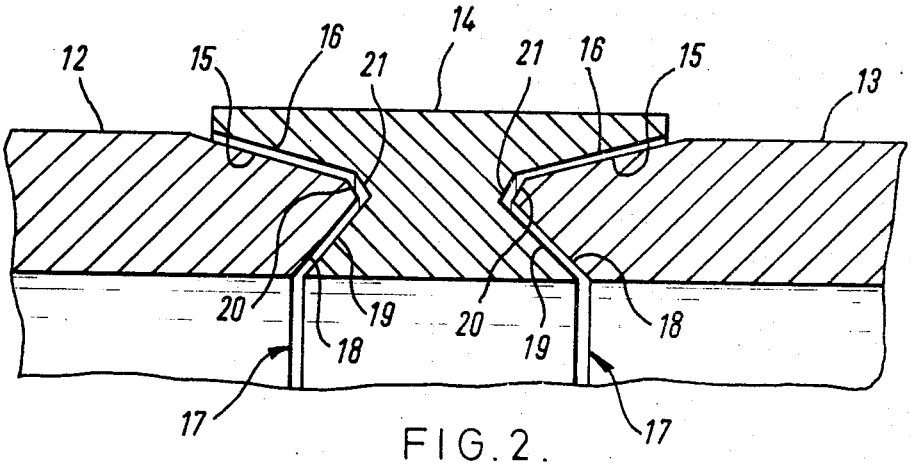
FIG. 2 is a diagrammatic fragmentary sectional view illustrating a tubing joint of the premium grade type (as hereinbefore defined)

FIG. 2 illustrates diagrammatically one form of premium grade tubing joint to which the method of the present invention is applicable. FIG. 2 shows a first tubing length 12 joined to a second tubing length 13 through the intermediary of a tubing coupling or box 14. The end of each tubing length 12 and 13 has a tapered externally-threaded portion 15 which co-operates with a correspondingly tapered internally-threaded portion 16 on the coupling 14. An end face 17 of each tubing length 12 and 13 is provided with a tapered shoulder 18 which co-operates with a correspondingly tapered shoulder 19 on the coupling 14. Between the tapered portion 15 and the end face 17 of each tubing length 12 and 13, there is defined an annular sealing area 20 which is engageable with a co-operating annular sealing area 21 defined between the tapered portion 16 and 19 of the coupling 14. It will be appreciated that although a tapered premium grade connection is described above, parallel premium grade connections can equally well be employed.

When each tubing length 12 and 13 is screwed into the coupling 14 the co-operating tapered shoulders 18 and 19 cause the seals 20 and 21 of each tubing length and coupling respectively to be forced into a metal-to-metal sealing engagement with each other to form a leakproof seal.

FIG. 2 illustrates an arrangement wherein two tubing lengths are connected together through the intermediary of a coupling. It will be readily appreciated, however, that a connection can equally well be made between two lengths of tubing without the provision of an intermediary coupling. In this case, the end of one tubing length is provided with a female profile similar to that of the coupling shown in FIG. 2.

Figure 3:
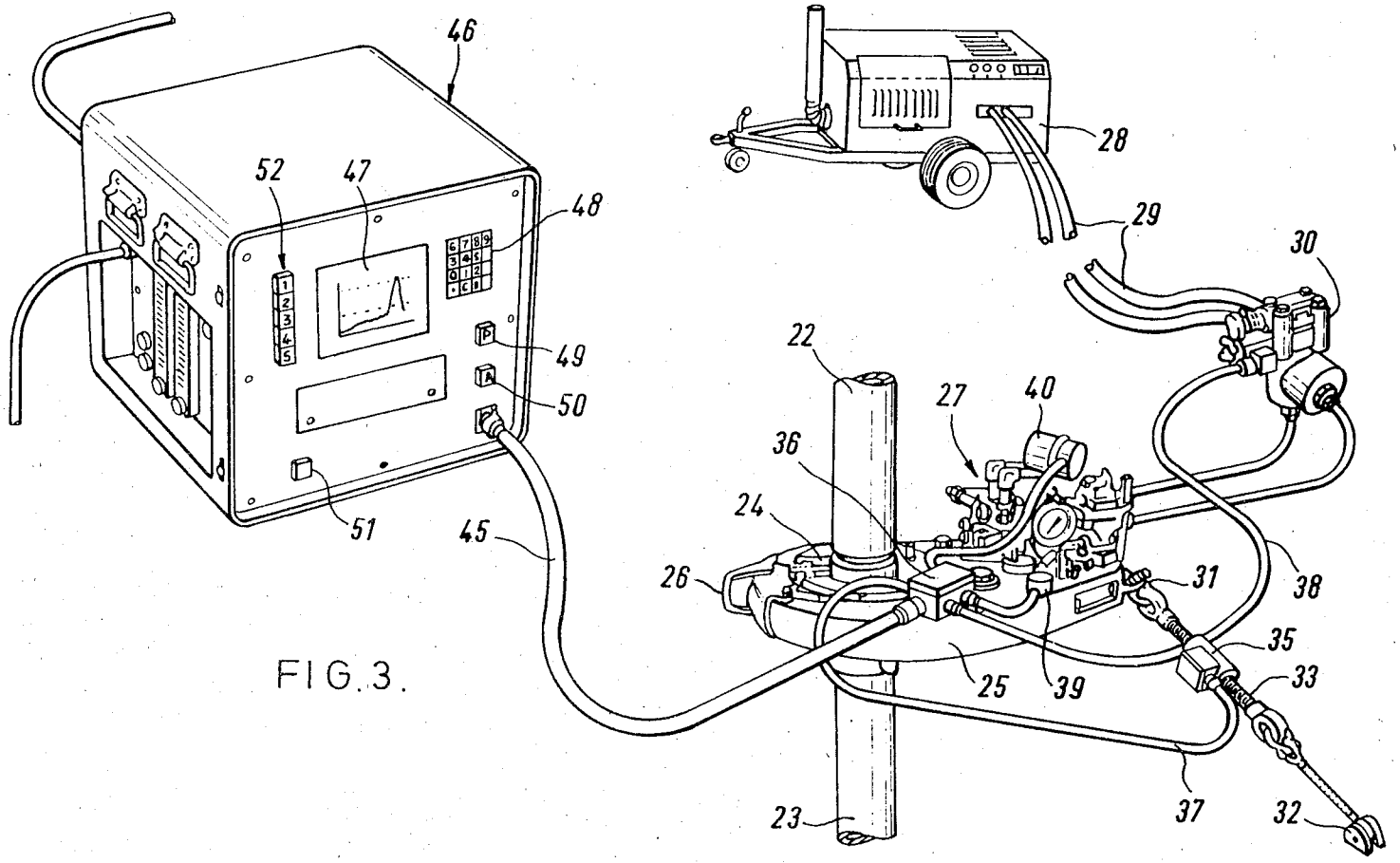
FIG. 3 is a perspective diagrammatic view of one form of apparatus for carrying out the method of the present invention for analysing the make-up of a tubing joint.
Figure 4:
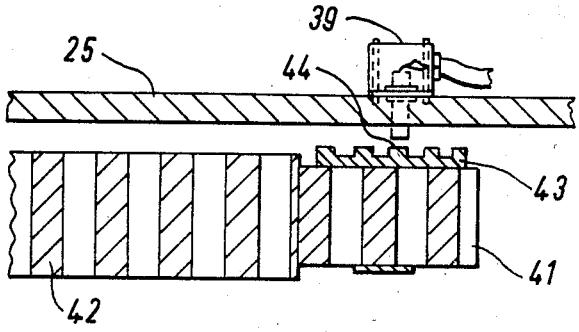
FIG. 4 is a fragmentary sectional view of the turns sensing mechanism of the apparatus of FIG. 3.

Referring now to FIGS. 3 and 4 of the drawings, there is shown an upper length 22 of production tubing having a lower externally-threaded end being joined to a lower length 23 of tubing having an internally threaded upper end, both sets of threading being premium threading. The lower length 23 of tubing is held stationary by means not shown, while the upper length 22 is rotated in a clockwise direction by means of a hydraulically driven rotary table 24 of a tong unit 25 which has substantially the shape of an elliptical disc with the rotary table mounted in the region of one of the axes of the ellipse. The tong unit 25 and the table 24 are split and held together by a clamping clip 26. When the clip is opened, the tong unit and table may be opened up so that the unit as a whole can be removed in a horizontal direction from engagement with the lengths of tubing.

The rotary table 24 is driven by hydraulic drive apparatus 27 mounted on the tong unit, hydraulic fluid being supplied from a remote hydraulic power pack 28 via a hydraulic fluid line 29 containing an electrically operated dump valve 30.

A point 31 on the tong unit 25 is anchored to a fixed anchor point 32 by a length of threaded rod 33 and a load cell or strain gauge assembly 35 is adjustably mounted in the rod. The load cell assembly is connected to a junction box 36 mounted on the tong unit by a signal line 37 and the junction box is connected to the dump valve 30 by another signal line 38. The junction box is also connected to an inductive proximity detector 39 for detecting rotational movement of the tong unit and to a horn 40 for giving an audible warning signal.

As best shown in FIG. 4, the proximity detector 39 is mounted above an idler gear 41 in a gear train driving the main rotor 42 of the tong unit, the idler gear 41 being rotatable about a vertical axis. A disc 43 bearing radially directed teeth 44 is fixed on the upper face of the idler roller 41 and the proximity detector 39 is mounted so as to be capable of detecting, by means of an impedance change within an oscillator circuit of the detector 39, the presence (or absence) of a tooth 44 of the disc 43 as the disc is rotated therebeneath and to provide a signal pulse every time a tooth 44 passes below the detector 39. The number of teeth 44 on the disc 43 is selected in dependence upon the size of the tong unit 25, and is given by the gear ratio of the idler gear 41 to the main rotor 42 divided into 100, whereby measurements can be resolved to, for example, one-hundredth of a turn.

A further line 45 leads from the junction box 36 to a graphical real time analyser 46 which is arranged continuously to monitor in real time the torque applied by the tong unit to the length of tubing 22 and the relative rotational movement of the lengths of tubing. The analyser is arranged to display graphically (as hereinafter described) the torque applied, to highlight the detection of the "shoulder" position, and to control the final torque values in accordance with a predetermined set of rules based on the values of torque at the shoulder position and stored in the analyser. The analyser is arranged to receive input signals from the strain gauge assembly 35 and proximity detector 39 and to provide output signals to the dump valve 30 and the horn 40. To this end the analyser includes a single-board computer, the operating instructions of which are partially in a high-level language and partly in machine code. The computer controls all of the data-gathering and data-analysing functions and provides the required output signals, including one for driving a 625-line 50-frame raster-scan colour display monitor 47 which serves to present the data relating to the tubing prior to the making up of a joint and the torque values during making up. The latter is presented as a colour graph, preferably with a change in plotting colour, e.g. green to red, following detection of the "shoulder" position or additionally or alternatively as large easily-readable characters if desired.

In the operation of the system just described, there are two operators, a tong operator who is not normally in a position to see the display monitor 47 and a computer operator who will normally be in a position to watch the display monitor and the tong operator and who will be able to equate the graph or any changes thereof with external influences on the joint, such as an increase in friction. The computer operator enters data relating to the particular lengths of tubing (based on size, weights, grades, connection types, etc.) into the analyser using a keyboard entry facility in the form of momentary contact switches 48. The ends of the lengths of tubing 22 and 23 are located and the joint is made up using the tong unit 25 in conventional manner. The hydraulic drive apparatus 27 operates the rotary table 24 which applies a torque to the upper length 22 of tubing. The reaction to the applied torque appears at the point 31 of the tong unit and acts on the load cell assembly 35 whereby a signal is generated which is fed to the analyser 46. During the make-up of the joint between the two lengths of tubing, the continuously varying torque values and the tubing data are analysed in accordance with a set of pre-programmed algorithms, including detection of rapid changes in the torque applied (detection of "shoulder" position). The analyser also checks these values against those limits within which known good joints exist. The result of the analysis determines the point of time at which the dump valve is actuated to stop the rotary table thereby ensuring either a good joint or a bad joint.

The horn 40 provides the operator with an audible indication of the state of the make-up and also a warning if the maximum tong r.p.m. is exceeded. The horn is a multi-tone horn and serves to warn the tong operator firstly that 80% of the optimum required torque has been reached (interrupted tone), secondly that the computer has registered a good connection according to the preprogrammed parameters (steady uninterrupted tone) or thirdly and alternatively, that the computer has registered a bad connection outside the preprogrammed parameters (frequency modulated tone). In the second and third cases the dump valve is also operated to stop the drive to the tong unit. The dump valve is also operated if the predetermined maximum tong r.p.m is exceeded. It is to be noted that the computer operator is alerted to the fact that the shoulder position has been reached by a colour change (e.g. green to red) on the display monitor 47.

In the case where a bad connection has been registered on the computer, then the connection will normally be undone or "broken out" and inspected for damage.

The data values monitored during the make-up are subsequently transferred to a magnetic storage medium for long term storage. From this record, data relating to past make-up operations can be reproduced either as a visual display or a hard copy on or off site. The stored information may be analysed and compared with the condition of the tubing during subsequent work over operations and may provide useful feedback for monitoring or controlling future programmes.

The analyser is provided with three groups of momentary-contact push-buttons 48, 49 and 50 to enable the operator to enter numerical data relating to the lengths of tubing and control data relating to the type of operation to be carried out as well as with a mains switch 51 and five function switches 52. By means of these buttons the operator may enter changes in the tubing datas, select a graphical or numeric display, automatically zero offsets in the torque measurement, store data relating to a make-up in a magnetic medium, and recall and display data relating to a make-up of a previous joint. Thus the operator may monitor, display and control a make-up.

The switches 52 are colourcoded (being numbered (1) to (5) in FIG. 3 of the drawing) and serve as selector switches for enabling the computer to perform various functions in dependence upon which menu is selected by switch 52(5). The menu is displayed on the screen of the monitor 47 and a selection of up to five choices on each menu is colour-coded to match the colour of the appropriate switch 52. For example, if Menu No. 1 is chosen then a choice of changing the values of the following parameters is made available.

MENU

1. Torque (red)
2. Turns (green)
3. Arm (Yellow)
4. Correction Factor (blue)
5. Move to next menu (violet)

The appropriate switch 52 is pushed. For instance if it is desired to change the torque value, then pressing switch 52(1) (red) will allow the computer operator to input new values using the keyboard entry facility 48.

On selection of the next menu, by pressing switch 52(5) (violet) then Menu No. 2 offers

MENU

1. Well number (red)
2. Joint number (green)

3. Analysis (yellow)
4. Customer (blue)
5. Move to next Menu (violet)

whereby a change of well number can be offered in pressing switch 52(1).

Pressing switch 49, labelled P denoting "proceed", allows the completed graph and associated information portrayed on the screen of the monitor to be recorded on an appropriate medium, such as a floppy disc. Switch 50, labelled A denoting "Abort" allows the connection from the monitor to be cancelled in the event of abortive make up or a bad connection.

By way of preliminary explanation, it has been determined in the present invention that, as a general rule, a satisfactory leak-proof joint in premium tubular connections, such as illustrated in FIG. 2, can be made if a predetermined amount of torque is applied after the socalled "shoulder position" has been reached. Initially, the torque required to make up such a connection is only that required to overcome interference and friction in the tapered threads of portions 15 and 16 and to extrude the thread compound. The torque rises gradually as the tubing is screwed up. When the mating shoulders 18 and 19 on the tubing length 12 or 13 and the coupling 14 begin to engage with each other, the torque applied rises dramatically. It has been found suitable, in order to achieve a good joint, to apply at least 50% of the optimum or manufacturer's recommended torque after the shoulder has been reached so long as the total torque applied is less than a predetermined maximum torque necessary for safety purposes.

The graphs on the display monitor 47 and as shown in FIGS. 5 and 6 incorporate a scaled vertical axis designating torque and a scaled horizontal axis designating turns. Horizontal lines 53,54, and 55 indicate appropriate limits for reference, optimum and maximum torque respectively and vertical line 57 represents maximum turns value. Vertical line 56 represents programmed maximum *torque* values. Minimum *turns* line is not shown as minimum turns selected (as shown to the right of the graph) is selected as 0.00. However, minimum turns line when shown is identical to maximum turns line 57 and placed along the X axis according to the value of minimum turns selected. A horizontal line 58 represents a value of 50% of optimum torque. 50% value has been found in practice to be a satisfactory basis for achieving leak-proof joints. It will be appreciated, however, that other proportions of optimum torque can be utilised according to circumstances and so long as a satisfactorily leak-proof joint is achieved.

Prior to a make-up operation, an operator enters a series of parameters which characterise the tubing and make-up procedure. For the particular tubing under consideration, the recommended optimum and maximum torque values and minimum and maximum turn values are entered into the analyser 46 together with any other preferred parameters which may be desired such as (a) the frictional coefficient of a lubricating compound used with the threaded joint.

(b) length of the lever arm measured from the longitudinal axis of the tubing to the moment of force applied to the load cell 35.

(c) horizontal angle correction factor to compensate for any deviation from 90° of the angle between the aforesaid lever arm and moment of force.

(d) vertical angle correction factor to compensate for deviation in the angle of the moment of force from a disposition parallel to the tong and rig floor.

(e) maximum tong speed (r.p.m.) to decrease possibility of galling of the threaded joint.

(f) identification data relating to the particular joint under consideration.

As the make-up of a joint proceeds, a graph of torque against turns is drawn in real time on the screen of the monitor 47 and, if desired on a hard copy. Simultaneously, a mathematical analysis is carried out of the torque and turn data, examining their rates of change and relationship to the preset limits to determine the point of shouldering and the final torque that must be applied to ensure a good joint. When this point is reached, the hydraulic dump valve 30 is operated. Alternatively, if the analysis shows that a good joint cannot be achieved or if the maximum tong speed is exceeded, the dump valve 30 is similarly operated. Throughout the analysis, computer checks are run on the incoming data to ensure that abnormalities such as a sudden change in torque due to a change of gear on the tong unit does not give a false indication of shouldering.

The entire torque-turn characteristics of each joint can be recorded on a magnetic disc. Each disc can store the characteristics of several hundred joints. This facility provides the opportunity of immediately recalling and displaying the torque turn characteristics of any past joint and provides a valuable archiving feature.

The form of graphical display on the monitor 47 is illustrated in FIGS. 5 and 6 which show examples of graphs relating to good and bad joints respectively. To the right of each graph is shown data relating to predetermined reference, optimum and maximum torque and minimum and maximum turns. It will be noted that each graph 5A and 5B incorporates an arrow indicating a location at which there is a sharp increase in the rate of change of the applied torque. This is an indication of the shoulder position. In an actual visual display on the monitor, the shoulder position would not normally be indicated by an arrow but would be indicated by a change in colour of the graph. In addition, the visual display would also indicate by, for example, a vertical line to the right of the graph, an indication of the tong speed. An output signal from the computer controls actuation of the dump valve or proportional valve to cut off hydraulic supply to the tong.

The x axis of the displayed graph represents turns, in one hundredths as determined by the proximity detector. Now, for example, if it is desired to plot a graph from "stabbing" i.e. when the two lengths of tubing are brought into contact, until the final make-up position, then the torque reference point from which the graph would originate would be zero units and the x axis would have to be long enough to accommodate the full number of turns from "stabbing" to make-up. However, if it is desired to display only the final shouldering stages of the make-up then the torque reference point is set at some value below the value anticipated at the approach to the shoulder position and the scale of the x axis can be correspondingly enlarged to take up the width of the screen of the display monitor. The values for the graph are selected by choice of appropriate menu.

Figure 5A:
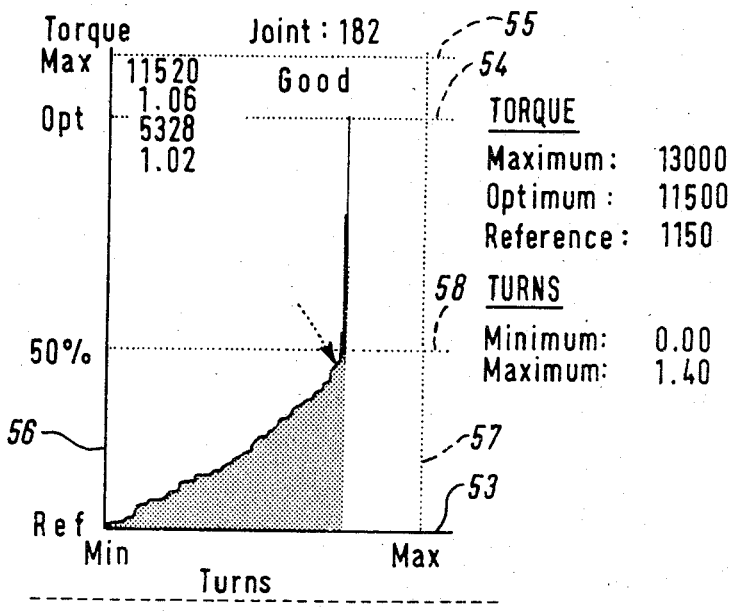
FIGS. 5A and 5B illustrate a graphical representation of the make-up of good tubing joints substantially as displayed on the apparatus of the invention during use thereof.

FIG. 5A shows a graph of a good joint in which the optimum torque is 11,500 ft. lbs. and the maximum torque is 13,000 ft. lbs. The applied torque and turns are continuously monitored and the graph of torque versus turns is progressively drawn on the visual display unit of the monitor 47. When the point on the graph indicated by the arrow is reached, an operator will observe a sharp increase in the rate of change of torque indicating that the shoulder position of a joint has been reached. The computer determines that the shoulder position is reached at a torque value which is less than 50% of the optimum torque indicated by horizontal line 54 and thereupon controls the tong 25 to apply further torque until the optimum torque is reached. The computer then actuates the dump valve 30 to cut off the drive to the tong unit 25 and the horn 40 is automatically sounded to indicate that a good joint has been made.

Figure 5B:
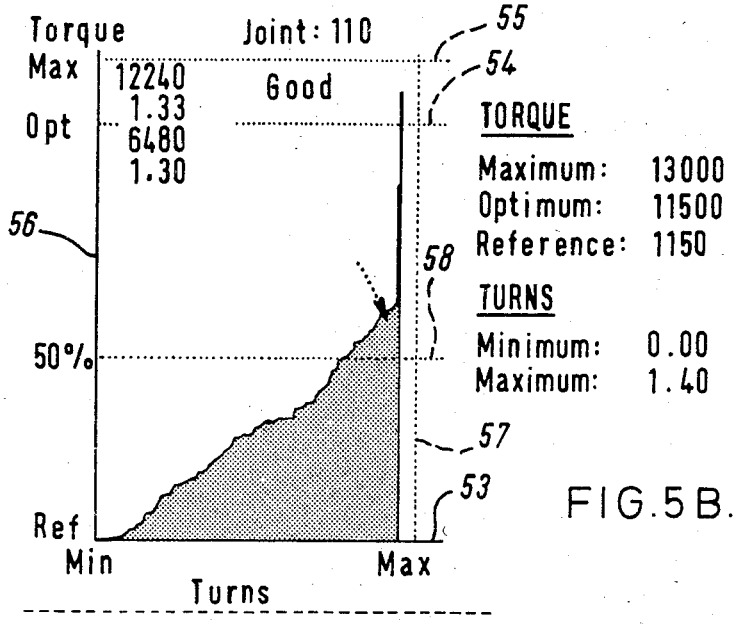

If, as shown in FIG. 5B, the shoulder torque is greater than 50% of the optimum torque, the computer will determine whether the application of a further 50% of optimum torque will achieve a final torque which is greater or less than the predetermined maximum torque indicated by horizontal line 55. If a value less than maximum torque will be achieved, the computer will control the tong unit 25 to permit a further 50% of optimum torque to be applied after the shoulder position has been reached thereby effecting a good joint.

Figure 6A:
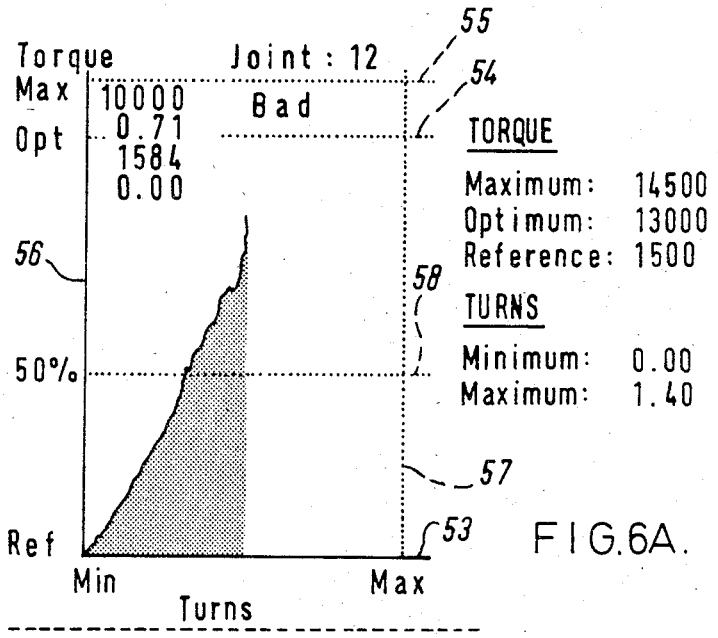
FIGS. 6A–C illustrate graphical representations of the make-up of bad tubing joints substantially as displayed on the apparatus of the invention during use thereof.

Alternatively, if the computer determines that the application of 50% of optimum torque beyond the shoulder position will result in a final torque which is above the maximum torque, the drive to the tong unit will be cut off and an audible signal will be emitted from horn 40 to indicate that a bad joint will be made. A graph illustrating such a joint is shown in FIG. 6A. In this case, the shoulder position is not reached until a torque of 10,800 ft. lbs. is reached. The further application of 50% of the optimum torque of 13,000 ft. lbs. would result in the maximum torque of 14,500 ft. lbs. being exceeded.

Figure 6B:
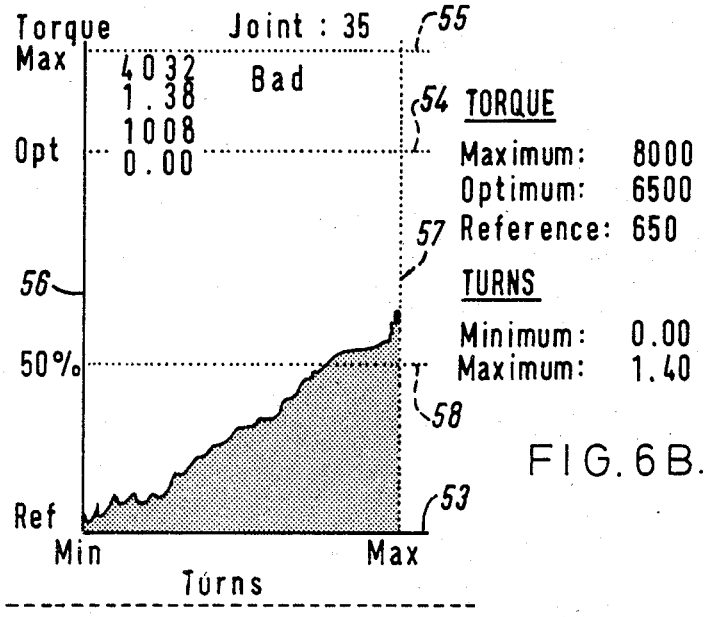

FIG. 6B is a graph illustrating the make-up of a joint in which the threads of the joint are dirty, damaged or improperly lubricated. In this case the shoulder position is not reached before achieving the predetermined maximum number of turns as indicated by vertical line 57. This joint may be successfully re-run after cleaning and lubrication.

Figure 6C:
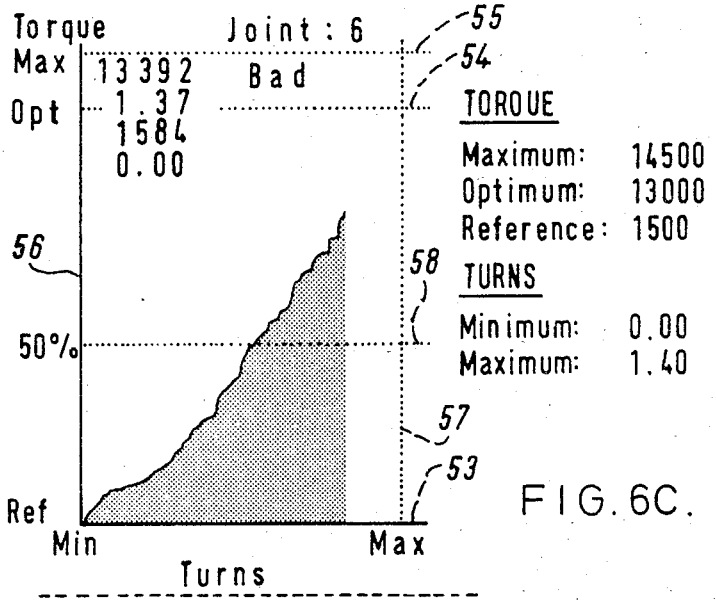

FIG. 6C is a graph illustrating the make-up of a joint of which the threads are so badly galled that the shoulder position is never reached. A similar graph would be drawn if the joint suffered from an incorrect taper due to improper machining.

It will be noted that in the top left hand corner of each graph there is shown numerically four sets of figures being, from top to bottom an indication of final torque, final turns, shoulder torque and shoulder turns.

The analyser is preferably adapted so that it is suitable for use in hazardous environments up to CENELEC Zone 1 specifications. To this end the line 20 is a multiway connector with all conductors protected to meet intrinsically safe specifications and to permit the input and output signals to pass from and into the analyser. Furthermore, the analyser 21 is connected by a line 28 to a source of compressed air for purging the interior of the analyser.

In the above described embodiments of the invention it will be noted that the method involves the plotting of torque against turns. It should be understood that torque need not necessarily be compared with turns but the engaging relationship between two pipe lengths can be continuously monitored by measuring another parameter such as time. In such a case time could form the basis for the x axis of a graph.

What is claimed is:

1. A method of making up a joint between two mutually-engageable threaded members which have a shoulder seal incorporated therein, said method comprising continuously monitoring the torque applied to rotate a first of said members relative to the second member; continuously monitoring the engaging relationship of the first and second members between a first position and a second position; detecting torque applied adjacent the location at which shoulder engagement takes place; comparing said shoulder torque in relation to a predetermined optimum torque and predetermined maximum torque; and either applying further torque amounting to a proportion of said optimum torque if the addition of said proportion of the optimum torque to the shoulder torque does not exceed the maximum torque and thereby effecting a good joint or ceasing to apply further torque if the torque comparison indicates that a good joint cannot be achieved.

2. A method as claimed in claim 1, in which the continuous monitoring of the engaging relationship of the first and second members is effected by continuously monitoring the turns which said first member makes relative to said second member.

3. A method as claimed in claim 1, in which said proportion of optimum torque is of the order of 50%.

4. A method as claimed in claim 1, comprising effecting the torque comparison by means of a computer and graphically and continuously displaying the joint make-up as it progresses whereby the location or absence of the shoulder position can be visually detected from the displayed graph.

5. A method as claimed in claim 4, comprising visually indicating the applied torque before and after the shoulder position by a change in colour of the graph.

6. A method as claimed in claim 4, comprising indicating on the graph the speed of rotation of the first member relative to the second member.

7. A method as claimed in claim 4, comprising identifying and storing each joint make up.

8. Apparatus for making up a joint between two mutually engageable threaded tubular members which have a shoulder seal incorporated therein, said apparatus comprising monitoring means for continuously measuring the torque applied to rotate a first of said members relative to the second member, monitoring means for continuously measuring the engaging relationship of the first and second members between a first position and a second position characterised in that there is provided means for detecting torque applied at the location adjacent which shoulder engagement takes place; comparison means for comparing said shoulder torque in relation to a predetermined optimum torque and predetermined maximum torque; and control means for either applying further torque amounting to a proportion of said optimum torque if the addition of said proportion of the optimum torque to the shoulder torque does not exceed the maximum torque and thereby effecting a good joint or ceasing to apply further torque if the torque comparison indicates that a good joint cannot be achieved.

9. Apparatus as claimed in claim 8, in which the monitoring means for continuously measuring the engaging relationship of the first and second members comprises means for continuously measuring the number of turns which the first member makes relative to the second member.

10. Apparatus as claimed in claim 8, in which the means for continuously measuring the number of turns which said first member makes relative to the second member comprises a rotatable tong element connectible to said first member to apply torque thereto to rotate it relative to the second member; a toothed member rotatable in relation to rotation of the tong element and said toothed member having a plurality of teeth; and an inductive proximity detector disposed adjacent the teeth of the toothed member whereby rotation of the toothed member in response to rotation of the tong element causes detection of the passage of each tooth by the proximity detector.

11. Apparatus as claimed in claim 10, in which the control means comprises hydraulic drive means for the tong element and a dump valve associated therewith, said dump valve being actuable in response to instructions from the computer in order to control operation of the hydraulic drive means.

12. Apparatus as claimed in claim 8, in which the torque detection and comparison means comprises a computer programmed with predetermined parameters relating to optimum and maximum torque and minimum and maximum turns and adapted to provide a continuous graphical display of joint make-up as it progresses whereby the location or absence of the shoulder position can be visually detected from the displayed graph.

13. Apparatus as claimed in claim 12, in which the computer has associated therewith a visual display unit in which the graph of the joint make up is continuously displayed.

14. Apparatus as claimed in claim 13, in which the graphical display of torque before and after the shoulder position is distinguished by a change in colour.

15. Apparatus as claimed in claim 8, in which means are provided for indicating the speed of rotation of the first member relative to the second member and effecting actuation of the control means to cease application of torque if said speed exceeds a predetermined amount.

16. Apparatus as claimed in claim 15, in which an indication of said speed of rotation is displayed in graphical form.

* * * * *